US007244044B2

(12) United States Patent
Liao

(10) Patent No.: US 7,244,044 B2
(45) Date of Patent: Jul. 17, 2007

(54) WATERPROOF LIGHT-EMITTING-DIODE ILLUMINATING DEVICE

(76) Inventor: Hsu-Wen Liao, No.7, Daren St., Pingjhen City, Taoyuan County 324 (TW)

( * ) Notice: Subject to any disclaimer, the term of this patent is extended or adjusted under 35 U.S.C. 154(b) by 158 days.

(21) Appl. No.: 11/043,137

(22) Filed: Jan. 27, 2005

(65) Prior Publication Data

US 2005/0248945 A1 Nov. 10, 2005

(30) Foreign Application Priority Data

May 5, 2004 (TW) ..... 93206959 U

(51) Int. Cl.
*F21V 13/14* (2006.01)

(52) U.S. Cl. ..... 362/252; 362/158; 40/550

(58) Field of Classification Search ..... 362/158, 362/249, 252, 255, 267; 40/550, 551
See application file for complete search history.

(56) References Cited

U.S. PATENT DOCUMENTS 5,555,163 A * 9/1996 Pisani ..... 362/252
6,318,886 B1 * 11/2001 Stopa et al. ..... 362/555
6,676,278 B2 * 1/2004 Striebel et al. ..... 362/267
6,719,441 B2 * 4/2004 Wong ..... 362/267

* cited by examiner

*Primary Examiner*—John Anthony Ward
(74) *Attorney, Agent, or Firm*—Rosenberg, Klein & Lee

(57) ABSTRACT

A light-emitting-diode (LED) illuminating device includes an object having a plurality of holes formed thereon, and at least one LED lamp bank consisting of a plurality of LED lamps serially connected together using an electric wire. The LED lamps are separately inserted in the holes on the object to show geometrical shapes or patterns, and/or word or words on the object, so that the object may be used as an illuminating signboard. Each of the LED lamps includes an LED and a protective member enclosing a rear part of the LED, so that the LED is waterproof and not subjected to breaking easily. The LED-illuminating device is easy to assemble, consumes less power, and has longer usable life and reduced cost.

11 Claims, 8 Drawing Sheets

WATERPROOF LIGHT-EMITTING-DIODE ILLUMINATING DEVICE

BACKGROUND OF THE INVENTION

1. Technical Field

The present invention relates to a waterproof light-emitting-diode (LED) illuminating device, and more particularly to a waterproof, easy-to-assemble, and durable LED-illuminating device that includes an object and a plurality of LED lamps mounted on the object and is suitable for use as a signboard or a decorative lamp.

2. Description of the Prior Art

FIG. 1 shows a conventional signboard 1, in which at least one lamp 2 is mounted to provide a light source to illuminate the signboard 1. The lamp 2 tends to burn out after being used over a long time, and is not easy to replace. Therefore, there are signboards with burned-out lamps here and there. Meanwhile, to increase the brightness and changes in colors of the signboard 1, tubular lamps filled with a certain type of inert gas have also been used in making the signboard 1. The tubular lamps must be sintered to form desired shapes or words before they can be connected to a power supply to emit light. The tubular lamp is bright enough but produces only mono-color light.

On the other hand, LED has the advantages of lower cost, less power consumption, and longer usable life as compared to the conventional lamps, and can therefore be advantageously used to make signboards. FIG. 2 shows a conventional manner of using LED's 3 as a light source to make a signboard. The LED's 3 are welded to a circuit board 4, which is then mounted in a box 5 with or without a colored cover. The box 5 is then used in making the signboard. It is very troublesome to make the signboard with LED's in the above-described manner, and the circuit board 4 and the arrangement of the LED's 3 must be designed according to customer-specified pictures or words. Therefore, the conventional signboard with LED's requires very high manufacturing cost.

Moreover, most of the conventional signboards with LED's installed outdoors are not waterproof, and must be moved indoors or turned out in a rainy day, or be additionally provided with external means to shield the signboards from rainwater. Therefore, the conventional signboards with LED's are not popular at least for the time being.

It is therefore tried by the inventor to develop a waterproof LED-illuminating device to overcome the problems in the conventional illuminating signboards.

SUMMARY OF THE INVENTION

A primary object of the present invention is to provide a waterproof LED-illuminating device that includes at least one LED lamp bank consisting of a plurality of LED lamps, and could be easily and quickly assembled for mounting on an object, such as a signboard, to emit changeful color light.

Another object of the present invention is to provide a waterproof LED-illuminating device that could be freely employed on signboards, tubular lamps, lighting fixtures, and decorating lamps to show various designs, pictures, and words.

To achieve the above and other objects, the waterproof LED-illuminating device of the present invention includes an object provided with a plurality of holes, and at least one LED lamp bank consisting of a plurality of LED lamps serially connected together using an electric wire. The object may be a signboard, an object in the form of a strip, an object showing a certain word, a spherical body, a flat body, a regularly shaped body, or an irregularly shaped body to show any geometrical shape and pattern and/or word or words thereon. The LED lamps are separately mounted in the holes on the object in an easy and quick manner. Each of the LED lamps includes an LED and a protective member enclosing at least a rear part of the LED to protect the LED against water and breaking. The protective member is made of a rubber material and has a radially inward curved peripheral wall defining a first end having a smaller end surface area and a second end having a larger end surface area. The LED is located in the first end of the protective member to project therefrom. The object may be a light-conducting object.

Preferably, the object is associated with a light-reflecting plate to reflect light emitted from the LED lamps and makes the LED-illuminating device brighter, and provide a space for receiving the electric wire between the object and the light-reflecting plate.

Preferably, the object is associated with a light-conducting element, so that the electric wire is located between the object and the light-conducting element, and light emitted from the LED lamps is guided by the light-conducting element to the whole LED lamp bank to make the LED-illuminating device brighter.

The structure and the technical means adopted by the present invention to achieve the above and other objects can be best understood by referring to the following detailed description of the preferred embodiments and the accompanying drawings, wherein

DETAILED DESCRIPTION OF THE PREFERRED EMBODIMENTS

Figure 1:
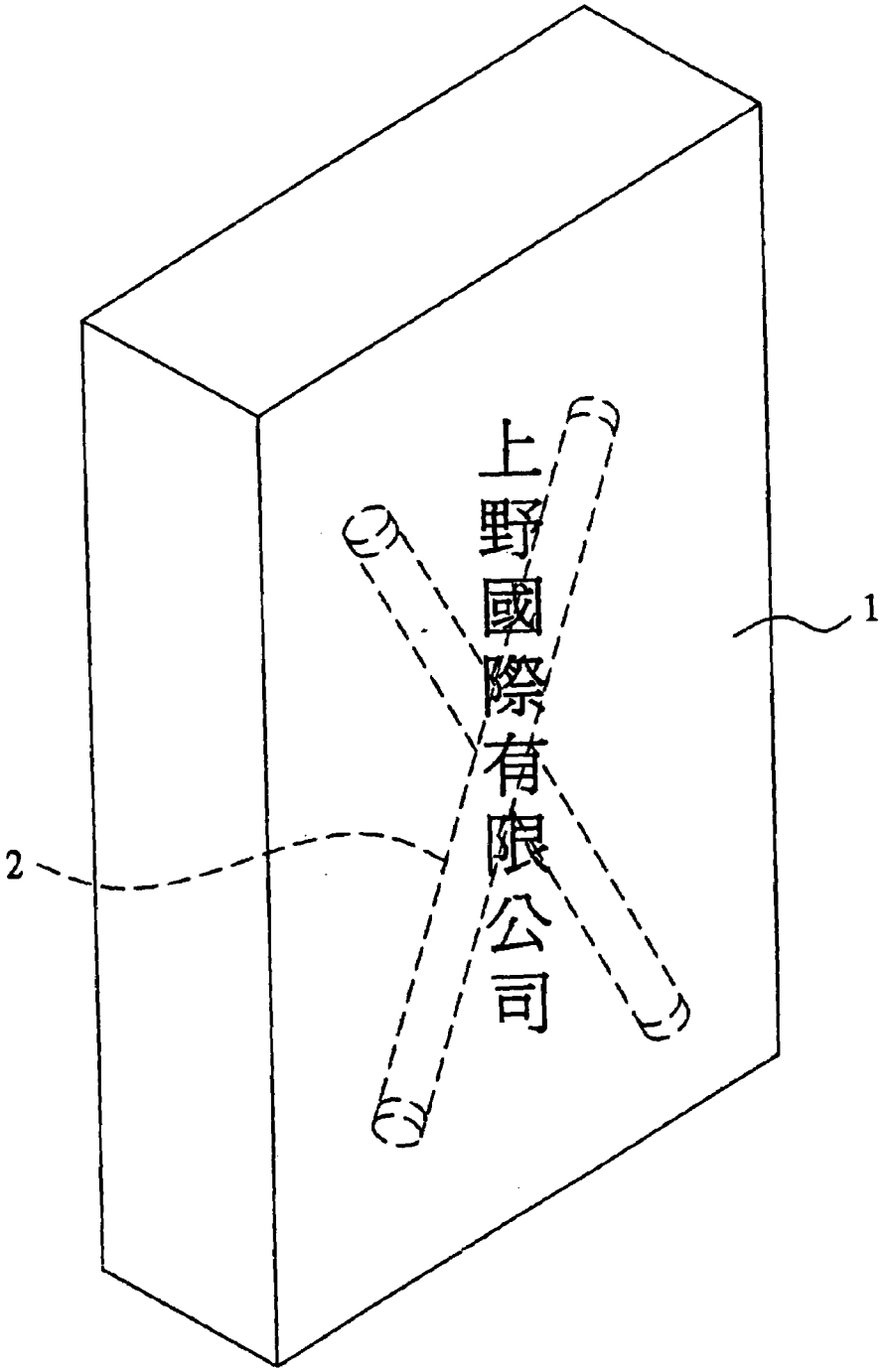
Fig. 1 PRIOR ART
FIG. 1 is a perspective view of a conventional signboard.
Figure 2:
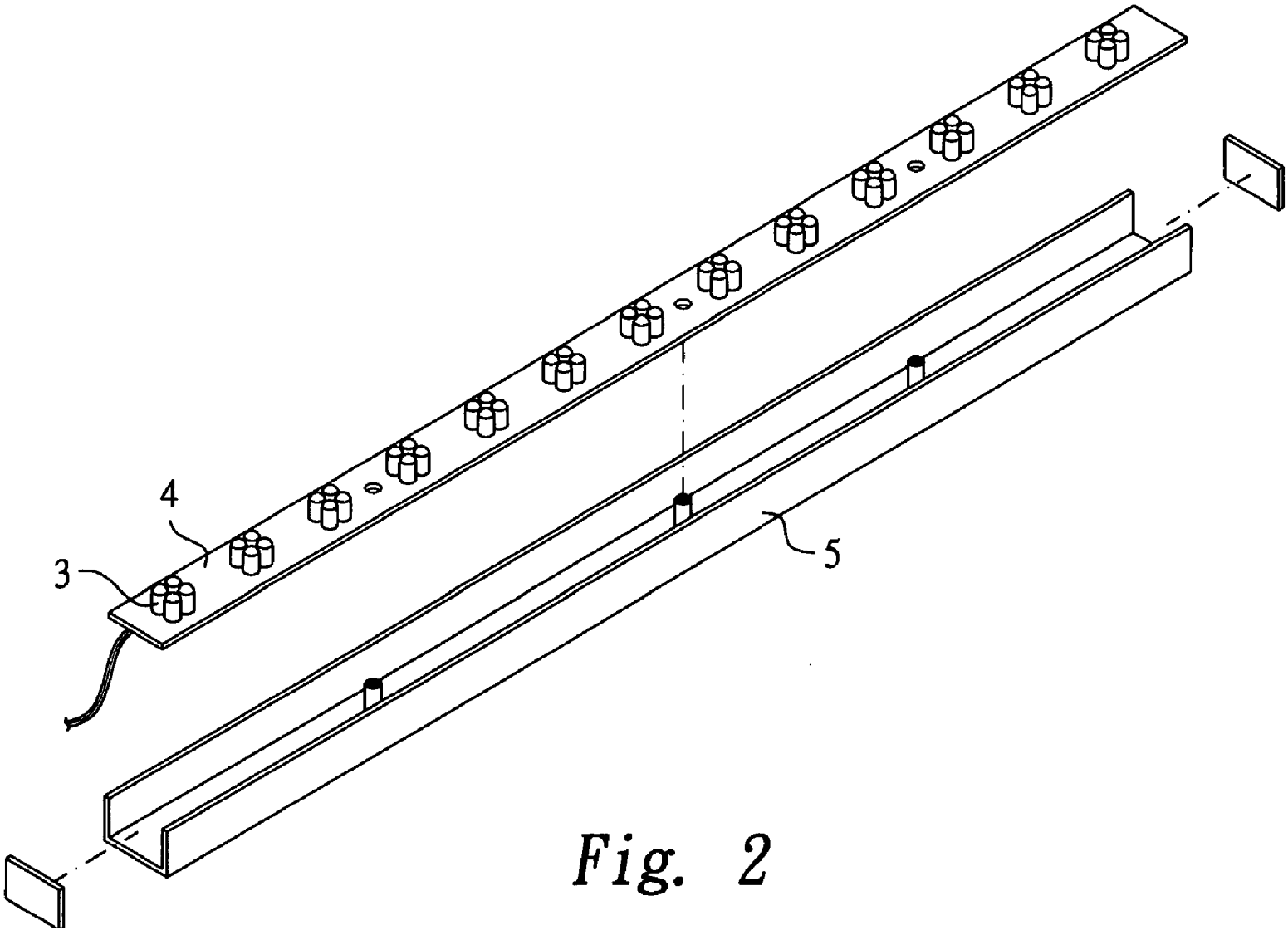
FIG. 2 is an exploded perspective view of a conventional LED signboard.
Figure 3:
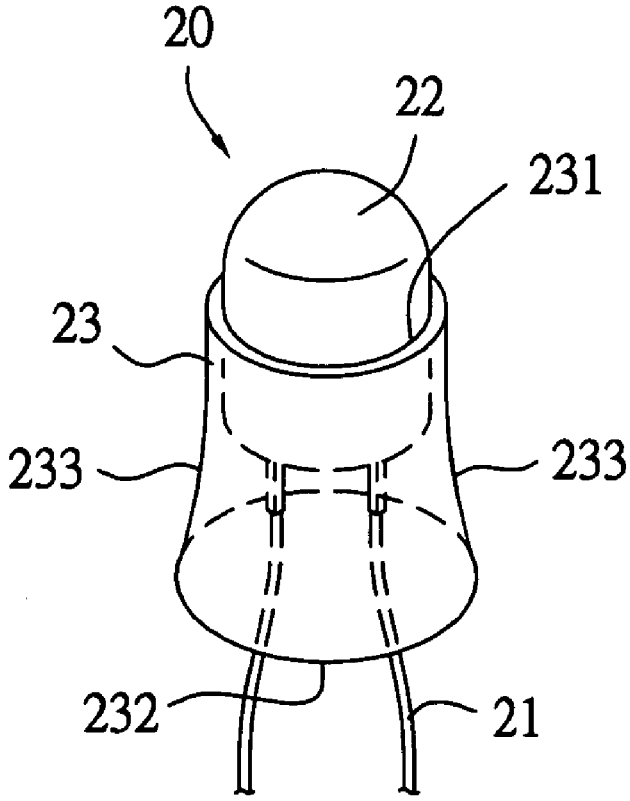
FIG. 3 is a perspective view of an LED lamp for forming an LED lamp bank in the waterproof LED-illuminating device of the present invention.
Figure 4:
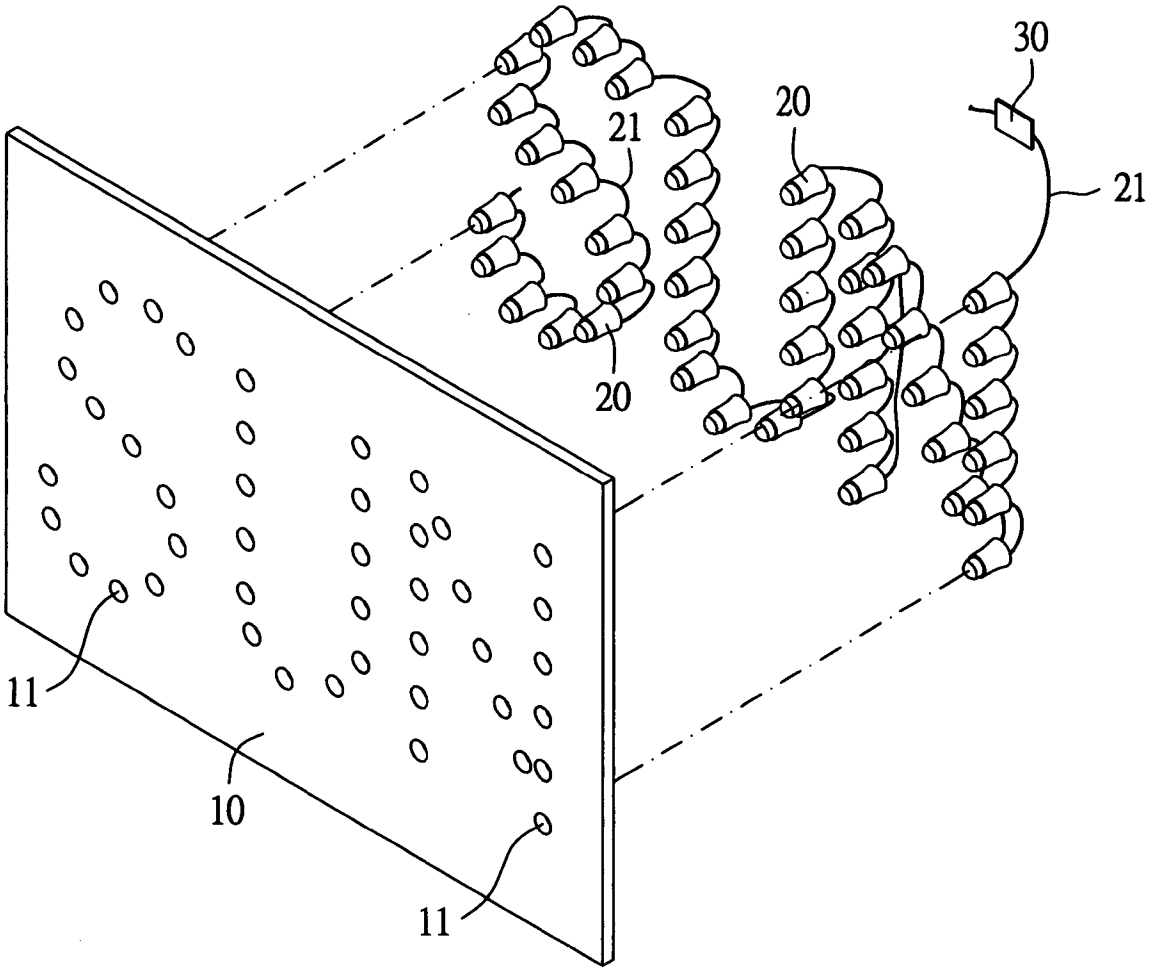
FIG. 4 is an exploded perspective view of a waterproof LED-illuminating device according to a first embodiment of the present invention.

Please refer to FIG. 3 that is a perspective view of a light-emitting-diode (LED) lamp 20 for forming an LED lamp bank in a waterproof LED-illuminating device of the present invention, and to FIG. 4 that is an exploded perspective view of a waterproof LED-illuminating device according to a first embodiment of the present invention. As shown, the waterproof LED-illuminating device of the present invention mainly includes an object 10 and at least one LED lamp bank consisting of a plurality of LED lamps 20. The object 10 may be of any geometrical shape and is provided with a plurality of holes 11 arranged in a desired manner. The object 10 may be made of a clear, an opaque, or a semitransparent material, and may be presented in different forms in practical applications thereof, such as a signboard, a strip-light lamp, a specially designed word pattern, a spherical body, a flat body, a regularly shaped body, or an irregularly shaped body.

The LED lamps 20 are serially connected together using an electric wire 21, but separately mounted in an individual hole 11 on the object 10. The electric wire 21 may be extended in length depending on actual need. The LED lamp bank may include LED lamps 20 emitting different color light or the same color light.

As can be seen from FIG. 3, each of the LED lamps 20 includes an LED 22, and a protective member 23 enclosing the LED 22. Preferably, the protective member 23 encloses a rear part of the LED 22 and the electric wire 21 to overcome the problems of water seepage and broken electric wire. The protective member 23 includes a first end 231 at where the LED 22 is located, and a second end 232 opposite to the first end 231. Preferably, the LED 22 has a front part projected from the first end 231 of the protective member 23 to provide better brightness.

To enable easy insertion of the LED lamps 20 into the holes 11 on the object 10, the protective member 23 is made of a soft rubber material to provide a desired elasticity, and is waisted. That is, the protective member 23 has a radially inward curved peripheral wall 233, and the first end 231 of the protective member 23 has an end surface area smaller than that of the second end 232.

The LED lamp bank for the waterproof LED-illuminating device of the present invention has at least the advantages of lower power consumption, longer usable life, not subjected to breaking easily, waterproof, available at lower cost, easy to assemble, and showing changeful colors.

As mentioned above, FIG. 4 shows a waterproof LED-illuminating device according to a first embodiment of the present invention. In the first embodiment, the object 10 is a flat rectangular signboard having a plurality of holes 11 formed thereon to show, for example, a word "SUN"; and the LED lamps 20 forming the LED lamp bank are separately inserted into the holes 11. The hole 11 has a size larger than the end surface area of the first end 231 of the protective member 23 and smaller than the end surface are of the second end 232 of the protective member 23. The elasticity of the protective member 23 enables the LED lamp 20 to firmly fix in the hole 11. Since the first end 231 of the protective member 23 has an end surface area smaller than that of the second end 232, the protective member 23 may be forward pushed into the hole 11 via the first end 231 until it is tightly clamped and immovable any further in the hole 11. After all the LED lamps 20 have been mounted in the holes 11, the LED-illuminating device is connected to a power source, so that the LED lamps 20 could be controlled via a controller 30 to emit light intermittently, continuously, circularly, or any other specially designed manners.

In addition to word or words, the signboard 10 may also include different designs or patterns.

Figure 5:
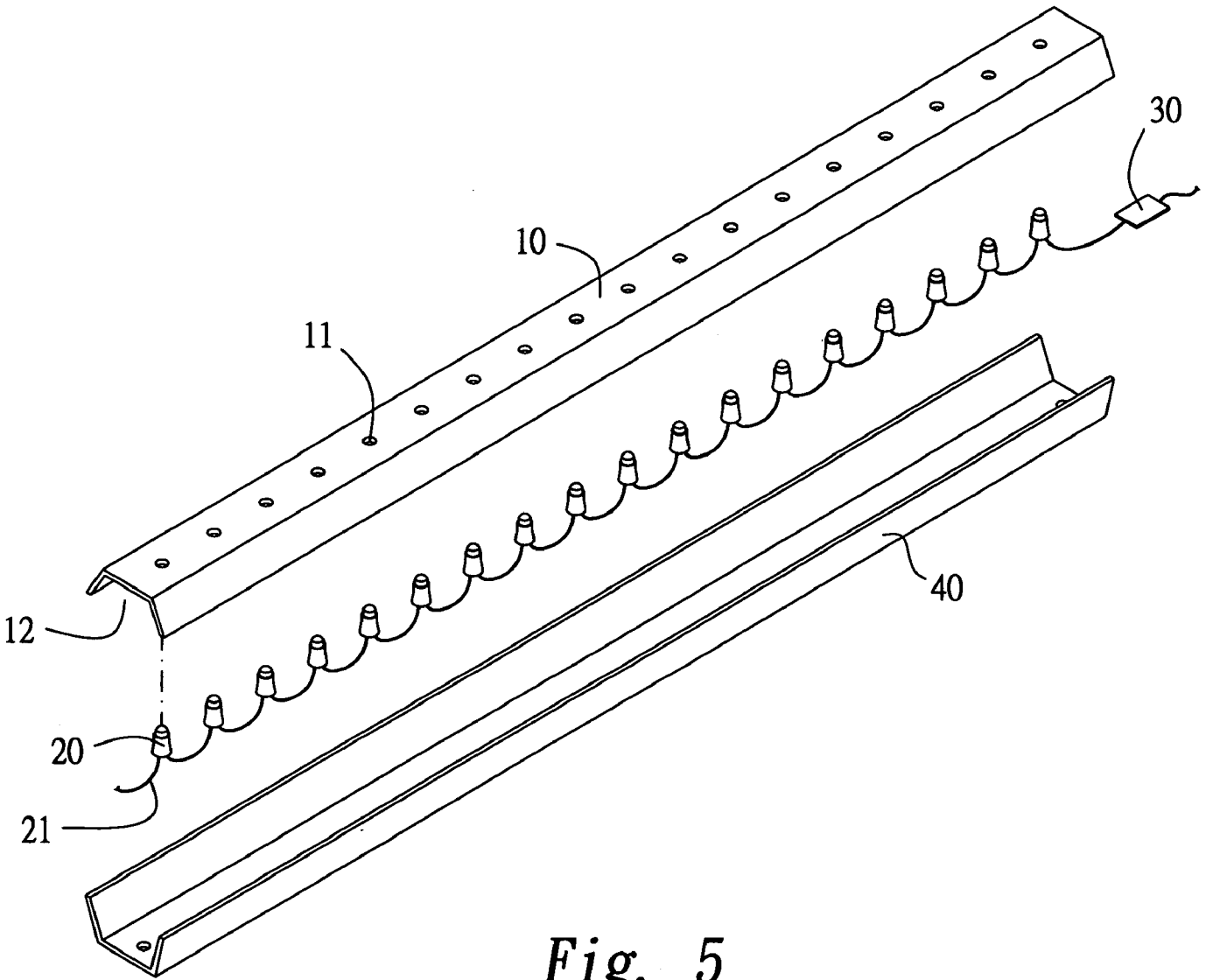
FIG. 5 is an exploded perspective view of a waterproof LED-illuminating device according to a second embodiment of the present invention.

FIG. 5 shows a waterproof LED-illuminating device according to a second embodiment of the present invention. In the second embodiment, the LED-illuminating device includes an object 10 made of a clear material and in the form of a long strip defining an open-bottomed channel 12. The channel 12 is provided at a top plane with a plurality of holes 11, in each of which an LED lamp 20 is mounted. A reflecting plate 40 capable of reflecting light emitted from the LED lamps 20 is associated with the object 10 to close the open bottom of the channel 12, so that an electric wire 21 serially connecting the LED lamps 20 together is invisibly located between the channel 12 of the object 10 and the reflecting plate 40. The reflecting plate 40 may be a flat plate other than a long strip as that shown in the second embodiment of FIG. 5, so long as the electric wire 21 and a rear part of the LED lamps 20 behind the holes 11 could be received between the channel 12 and the reflecting plate 40. When the LED-illuminating device of the second embodiment is connected to a power source, the LED lamps 20 could be controlled via a controller 30 to emit light intermittently, continuously, circularly, or any other specially designed manners. The reflecting plate 40 reflects light emitted from the LED lamps 20 and makes the whole LED-illuminating device of the present invention brighter. The object 10 may be directly punched or processed in other manners to form the holes 11, and the LED lamps 20 may be easily inserted into the holes 11 one by one. Thereafter, the reflecting plate 40 could be easily and quickly assembled to the back of the object 10 to complete the waterproof LED-illuminating device of the present invention.

Preferably, the object 10 in the second embodiment of the present invention may be otherwise associated with a light-conducting element made of a transparent material, so that light emitted from the LED lamps 20 is transferred to the whole LED lamp bank via the light-conducting element to make the whole LED illuminating device of the present invention brighter. Meanwhile, the object 10 may also be made of a light-conducting material.

Figure 6:
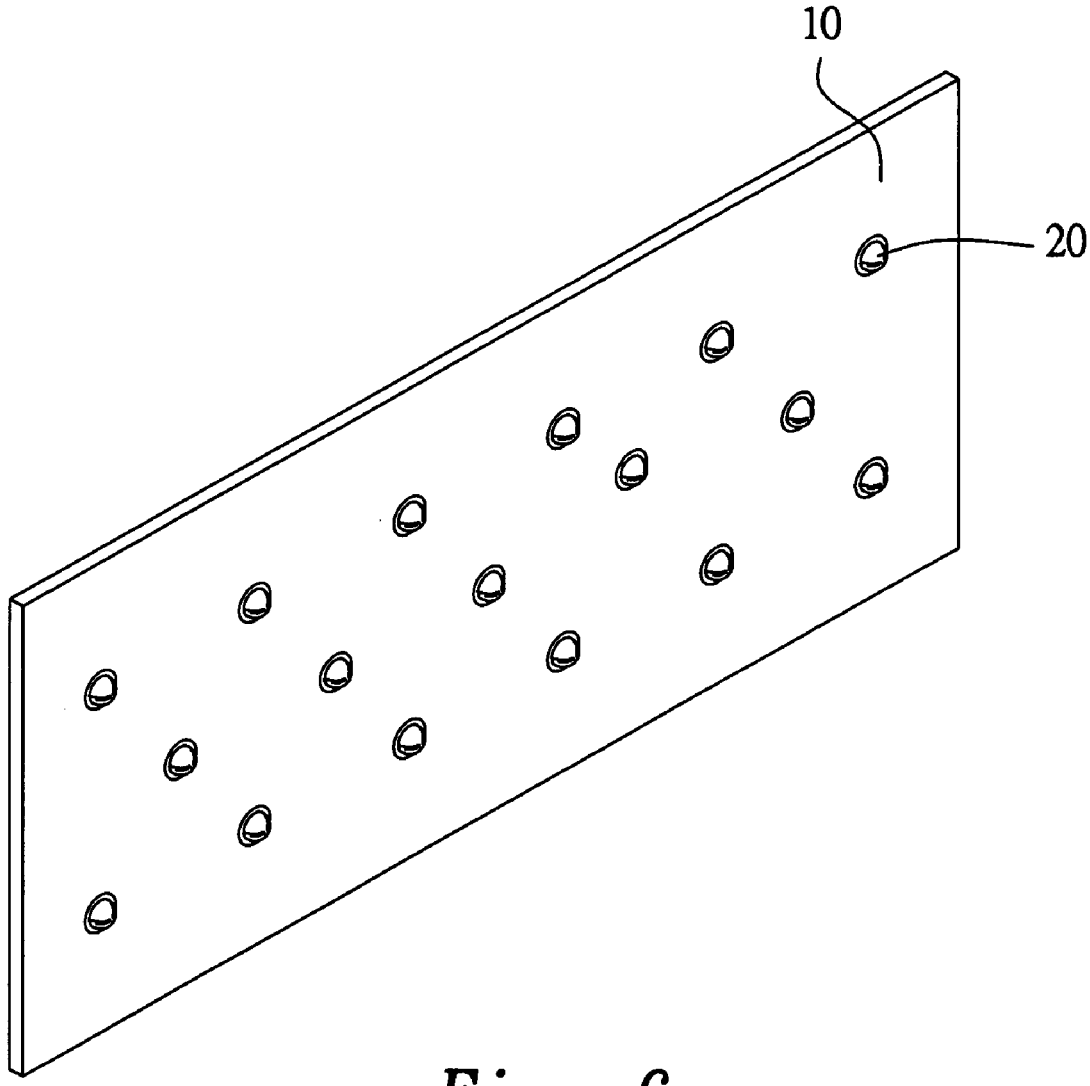
FIG. 6 is an assembled perspective view of a waterproof LED-illuminating device according to a third embodiment of the present invention.

FIG. 6 shows a waterproof LED-illuminating device according to a third embodiment of the present invention. In the third embodiment, the LED-illuminating device includes an object 10 in the form of a flat plate, and an LED lamp bank consisting of a plurality of LED lamps 20 separately mounted on the object 10 to emit different color light, and is therefore suitable for use as a wall lamp in landscaping, a ceiling lamp directly attached to ceiling, a concealed lamp, a display lamp, etc. The waterproof LED-illuminating device according to the third embodiment of the present invention could be more quickly assembled and installed and provides more changeful color light than conventional wall lamps with bulbs.

Figure 7:
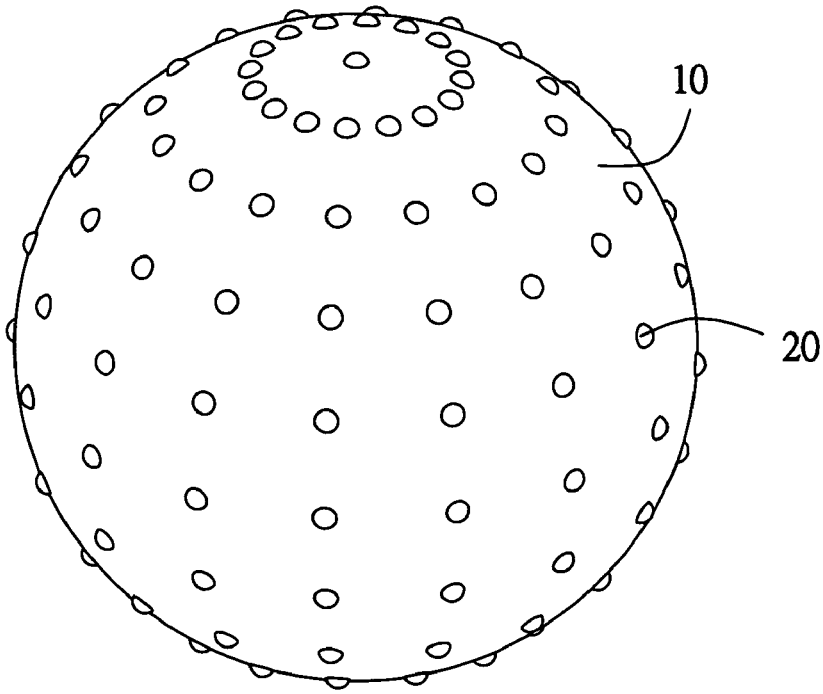
FIG. 7 is an assembled perspective view of a waterproof LED-illuminating device according to a fourth embodiment of the present invention.

FIG. 7 shows a waterproof LED-illuminating device according to a fourth embodiment of the present invention. In the fourth embodiment, the present invention includes a spherical object 10 and an LED lamp bank consisting of a plurality of LED lamps 20 separately mounted on the spherical object 10 to emit different color light, and is therefore suitable for use as lighting fixture in dancing halls, decorative lighting fixture to create special atmosphere in home, a display lamp, a roadside guiding light, etc. Again, the waterproof LED-illuminating device according to the fourth embodiment of the present invention could be more quickly assembled and installed and provides more changeful color light than conventional lighting fixtures.

Figure 8:
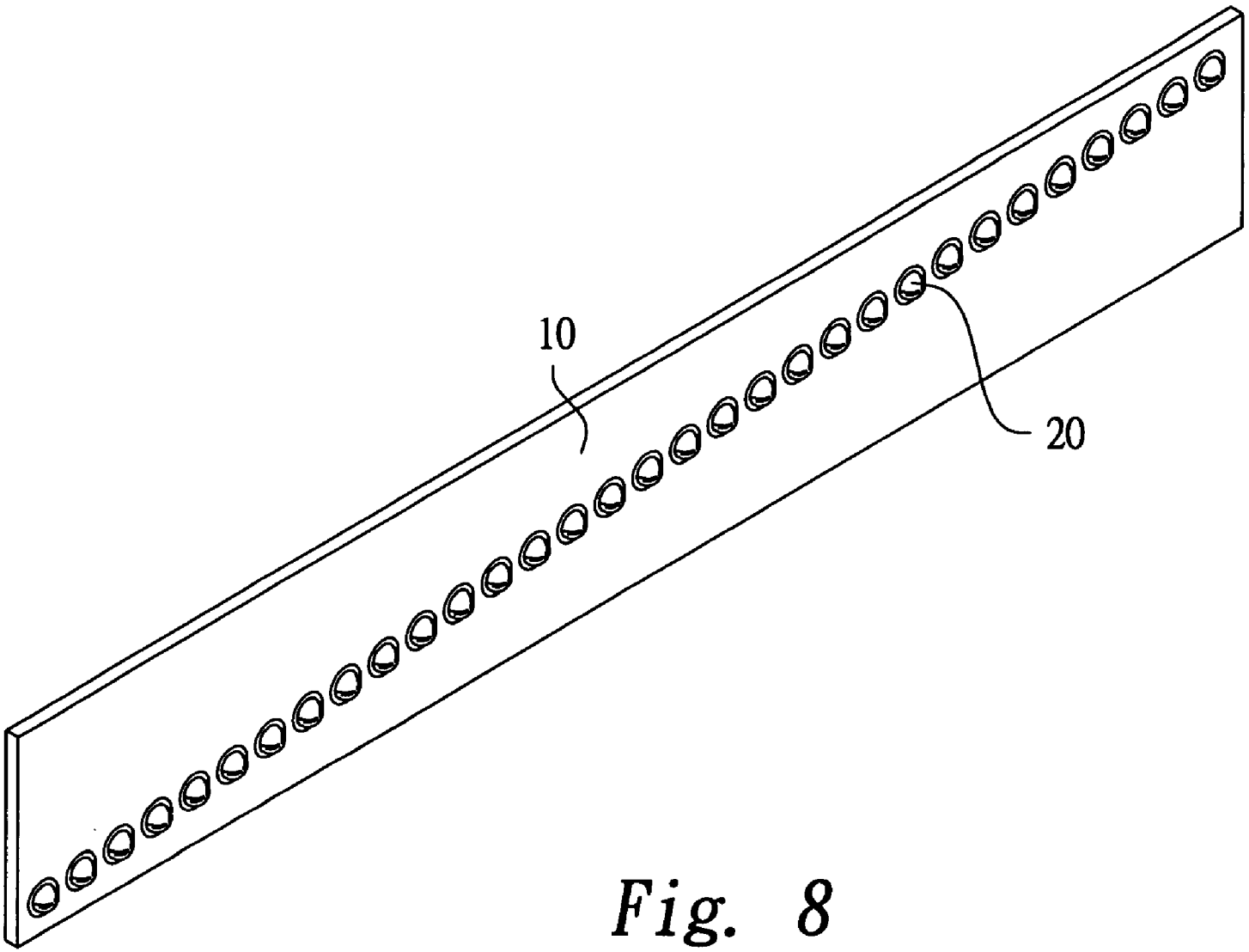
FIG. 8 is an assembled perspective view of a waterproof LED-illuminating device according to a fifth embodiment of the present invention.

FIG. 8 shows a waterproof LED-illuminating device according to a fifth embodiment of the present invention, which is mainly designed to provide a dynamic display lamp suitable for mounting on an outer side of a car body. The LED-illuminating device of this embodiment includes an object 10 and an LED lamp bank consisting of a plurality of LED lamps 20 mounted on the object 10 to emit mono or different color light. To produce a dynamic visual effect, the LED lamps 20 are differently sized and arranged in specific manners, such as in one line from larger ones to smaller ones, so as to meet diversified demands in car decoration.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A light-emitting-diode (LED) illuminating device, comprising:

an object showing a geometrical shape, on which a plurality of holes are provided and arranged to show desired geometrical shapes or patterns, or words; and at least one LED lamp bank consisting of a plurality of LED lamps serially connected together using an electric wire, said LED lamps being separately mounted in and protruding from said holes on said object, and each of said LED lamps including an LED and a protective member enclosing said LED; said protective member having a first end where said LED is located, and a second end opposite to said first end; a portion of said LED protruding from said first end of said protective member; and said first end of said protective member having an end surface area smaller than that of said second end.

2. The LED-illuminating device as claimed in claim 1, wherein said object is selected from the group consisting of signboards, objects in the form of a strip, specially designed word patterns, spherical bodies, flat bodies, regularly shaped bodies, or irregularly shaped bodies.

3. The LED-illuminating device as claimed in claim 1, wherein said protective member encloses a rear part of said LED and said electric wire connected thereto.

4. The LED-illuminating device as claimed in claim 1 or 3, wherein said protective member is made of a rubber material.

5. The LED-illuminating device as claimed in claim 1, wherein said LED lamps are mounted in said holes on said object by separately inserting said protecting members into said holes via said first end of said protective members.

6. The LED-illuminating device as claimed in claim 1, further comprising a reflecting plate capable of reflecting light, and said reflecting plate being associated with said object with said electric wire located between said object and said reflecting plate.

7. The LED-illuminating device as claimed in claim 1, further comprising a light-conducting element, and said light-conducting element being associated with said object with said electric wire located between said object and said light-conducting element.

8. The LED-illuminating device as claimed in claim 7, wherein said light-conducting element is made of a transparent material.

9. The LED-illuminating device as claimed in claim 1, wherein said object is a light-conducting plate.

10. The LED-illuminating device as claimed in claim 1, wherein said protective member has a radially inward curved peripheral wall.

11. The. LED-illuminating device as claimed in claim 10, wherein each of said holes on said object has a size larger than the end surface area of said first end of said protective member and smaller than the end surface area of said second end of said protective member.

* * * * *